US011767672B2

(12) United States Patent
Hansen et al.

(10) Patent No.: US 11,767,672 B2
(45) Date of Patent: Sep. 26, 2023

(54) MODULAR BUILDING CONSTRUCTION

(71) Applicant: L2U Group Pty Ltd, Gooseberry Hill (AU)

(72) Inventors: Klaus Hammersholt Hansen, Gooseberry Hill (AU); Andrew David Hunter, Cola Point (AU)

(73) Assignee: L2U Group Pty Ltd, Gooseberry Hill Western (AU)

( * ) Notice: Subject to any disclaimer, the term of this patent is extended or adjusted under 35 U.S.C. 154(b) by 116 days.

(21) Appl. No.: 17/262,404

(22) PCT Filed: Jul. 24, 2019

(86) PCT No.: PCT/AU2019/050774

§ 371 (c)(1),
(2) Date: Jan. 22, 2021

(87) PCT Pub. No.: WO2020/019027

PCT Pub. Date: Jan. 30, 2020

(65) Prior Publication Data

US 2021/0293021 A1 Sep. 23, 2021

(30) Foreign Application Priority Data

Jul. 25, 2018 (AU) ..... 2018902691
Nov. 22, 2018 (AU) ..... 2018904453

(51) Int. Cl.
*E04C 2/32* (2006.01)
*E04D 3/24* (2006.01)
*E04B 1/344* (2006.01)

(52) U.S. Cl.
CPC ..... *E04C 2/322* (2013.01); *E04B 1/3445* (2013.01); *E04D 3/24* (2013.01)

(58) Field of Classification Search
CPC . E04C 2/322; E04C 3/24; E04C 3/352; E04C 3/362; E04B 1/3445
See application file for complete search history.

(56) References Cited

U.S. PATENT DOCUMENTS 3,807,104 A 4/1974 Webster
6,253,498 B1 * 7/2001 Fanucci ..... E04B 1/3445 52/143
8,256,443 B2 9/2012 Neal
8,695,284 B2 * 4/2014 Ho ..... E04H 1/125 52/79.5
2010/0018130 A1 1/2010 Lopez et al.
2017/0051497 A1 * 2/2017 Kolbe ..... E04H 1/1205

FOREIGN PATENT DOCUMENTS

WO WO-2005/124049 A1 12/2005

OTHER PUBLICATIONS

International Search Report from corresponding International Patent Application No. PCT/AU2019/050774, dated Oct. 29, 2019.

* cited by examiner

*Primary Examiner* — Andrew J Triggs
(74) *Attorney, Agent, or Firm* — KUSNER & JAFFE

(57) ABSTRACT

A building panel is constructed of a corrugated material. The panel can be folded into a U-shaped configuration. Successive folded panels can be coupled together using complementary shaped corrugations to fix panels in position relative to each other. Shaped connectors can be used to connect building panels in one plane to building panels in another plane.

7 Claims, 10 Drawing Sheets

MODULAR BUILDING CONSTRUCTION

FIELD OF THE INVENTION

The present invention relates to the construction of buildings in a modular fashion from constituent parts.

BACKGROUND TO THE INVENTION

International patent publication number WO 2005/124049 describes a building system including walls constructed from overlying corrugated panels. Each panel is formed from two L-shaped corrugated sheets, which are arranged to form a U-shaped panel having a base including an overlap region between the corrugated sheets and single thickness side walls. The side walls are held in relative position by bracing members.

Testing of the building system of WO 2005/124049 has confirmed a high degree of strength and stability, particularly compared to the relatively low weight of structures thus assembled. The building system requires a degree of expertise to assemble, in particular with the correct installation of bracing members within panels. In addition, the stacking of the L-shaped corrugated sheets for transport can be cumbersome.

The present invention seeks to provide a system for the construction of buildings in a modular fashion which achieves some of the advantages of the system of WO 2005/124049 and avoids some the identified disadvantages.

SUMMARY OF THE INVENTION

According to one aspect of the present invention there is provided a panel for use in a modular building, the panel including a first side wall, a second side wall, and a base portion; the panel being movable between a first position and a second position; whereby when the panel is in the first position the first side wall and the second side wall are angled with respect to each other, and when the panel is in the second position the first side wall is generally parallel to and opposed to the second side wall. It will be appreciated that the first position represents a position in which a plurality of panels can be readily stacked for transport; and the second position represents an assembled position in which the panels can be used to form a wall of a building.

The panel may be a wall panel, a floor panel, a roof panel or other desired building panel.

In the first position the first side wall and the second side wall will be relatively disposed at an angle less than 180°. This could be an angle of zero degrees, where the first side wall, the base portion, and the second side wall are generally in the same plane, through to an angle of 90° and even higher.

Put in other terms, it will be understood that the panel may be flat or nearly flat when in its first position.

It is preferred that at least one of the first side wall and the second side wall are joined to the base portion along a longitudinally extending bend, whereby movement of the panel between its first and second positions is achieved by rotation of at least one of the first and second side walls relative to the base portion about the respective longitudinally extending bend.

The bend(s) may be formed by a thinning of material in a longitudinal direction. Alternatively, the bend(s) may be formed by perforations within the body of the panel.

In another embodiment, at least one of the first side wall and the second side wall may be joined to the base portion at a hinge, such that movement of the panel between its first and its second positions can be achieved by rotation of at least one of the first and second side walls relative to the base portion about the respective hinge.

In an alternative embodiment the base portion includes a first base portion joined to a second base portion along a longitudinally extending bend, whereby movement of the panel between its first and second positions is achieved by movement of the first base portion relative to the second base portion about the longitudinally extending bend.

In this embodiment the first base portion may be connected to the first side wall at a bend of about 90°, and the second base portion is connected to the second side wall at a bend of about 90°. In this embodiment the first position of the panel may be represented by the first base portion being bent relative to the second base portion at an angle between about 60° and about 150°; and the second position of the panel represented by the first base portion being parallel to the second base portion.

It is preferred that the base portion locates internally of the side walls when in its first position.

The panel is preferably constructed from a corrugated material, having ridges and grooves extending in the longitudinal direction. In one embodiment, the corrugations may be angular, using straight sections. Alternatively, the corrugations may be curvilinear. It will be understood that where the panel is described as 'flat' in its first position, this does not exclude the panel being formed from corrugated material: it is a reference to the state of the first and second bends.

The panel may include further longitudinally extending bends located on the first side wall and/or the second side wall. Movement of side wall portions about a further longitudinally extending bend preferably permits movement of the panel into a third position in which the panel is closed at an outer end remote from the base portion, or into a fourth position in which an outer portion of a side wall extends away from the panel in a direction parallel to the base portion.

It will be appreciated that in the third position the panel becomes effectively a single box beam.

In accordance with a second aspect of the present invention there is provided a method of forming a portion of a building element, the method including the steps of:

providing a first panel and a second panel, each panel having a first side wall and a second side wall, the side walls being constructed from a corrugated material;

moving the panels into an assembled position whereby the first side wall of each panel is parallel to the corresponding second side wall; and locating the second panel at least partially within the first panel, such that a portion of the first side wall of the second panel overlaps a portion of the first side wall of the first panel, the overlapping portions being complementary in shape.

The building element is preferably a building wall. Alternatively, it may be a floor, ceiling, roof or other constituent element.

The overlapping portion may represent a single corrugation wave form. Alternatively, the overlapping portion may represent two or more corrugation wave forms.

The panels may be associated with a plurality of coupling members. In a preferred embodiment, each coupling member has a first face shaped to complement an internal portion of the first side wall; a second face shaped to complement a corresponding internal portion of the second side wall; and an outer face shaped to complement an abutting panel.

The outer face of each coupling member preferably has a raised surface and a lowered surface, the raised surface and the lowered surface each being perpendicular to the first and second faces.

Alternatively, the outer face of the coupling member may include a portion which is angled at an obtuse angle relative to at least one of the first and second faces. In a preferred embodiment, the obtuse angle is about 72°. In use, this allows for attachment of a roof panel to the outer face, the roof panel having an 18° pitch.

The building wall may include at least one channel member arranged to engage with the panels. In a preferred embodiment, the channel member has side walls arranged to locate internally of the panel side walls. The channel member may have locating slots within which base portions of the panels may locate.

The method may include the further step of pinning the panel side walls to the channel member side walls. This may be done through use of a deformable fastener.

In accordance with a third aspect of the present invention there is provided a connecting member for engaging with a building panel, the building panel having side walls formed of a corrugated material;

the connecting member having an outer face including a raised planar surface, a lowered planar surface, and a sloped planar surface connecting the raised planar surface and the lowered planar surface, the sloped planar surface being generally rectangular; the raised planar surface being parallel to the lowered planar surface, a join between the sloped planar surface and the raised planar surface defining an orientation direction of the connecting member;

the connecting member having four side walls, each shaped to engage with the corrugated material;

the connecting member having a first orientation wherein the orientation direction of the connecting member is parallel to the side walls of the building panel and a second orientation wherein the orientation direction of the connecting member is perpendicular to the side walls of the building panel.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Figure 1:
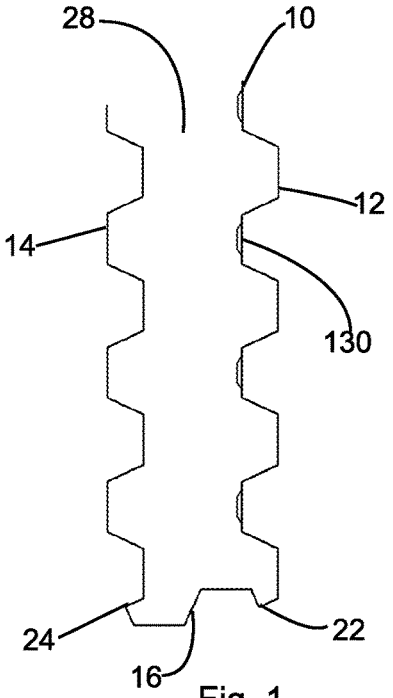
FIG. 1 is a cross section of a wall panel in accordance with a first embodiment of the present invention, shown in a first position.
Figure 2:
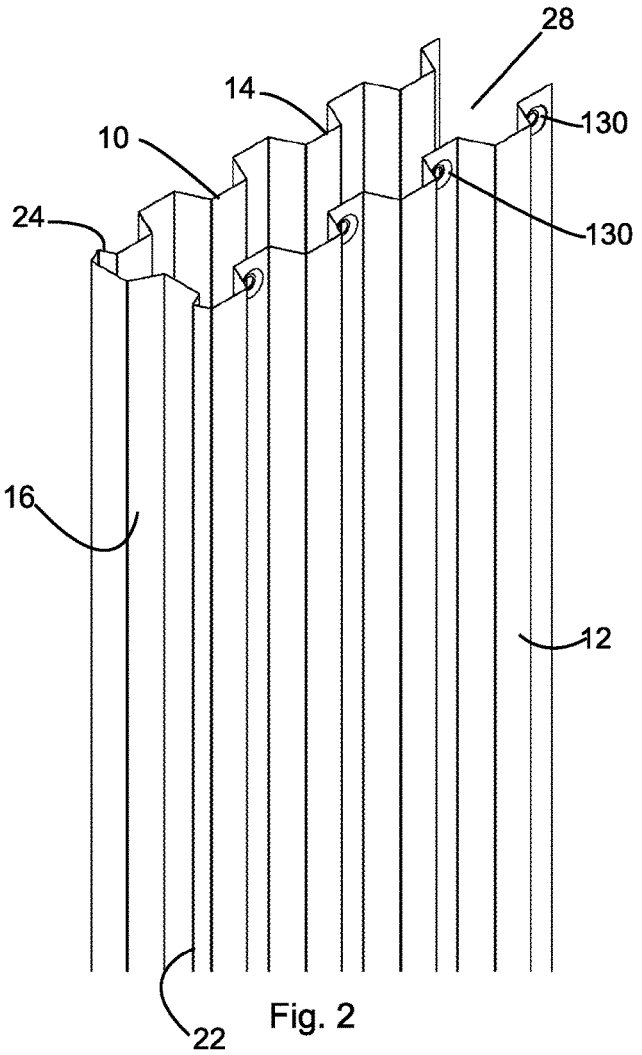
FIG. 2 is a perspective of an end of the wall panel of FIG. 1.

Referring to the Figures, FIGS. 1 and 2 show a wall panel 10 formed of an angular corrugated material. The wall panel 10 has a first side wall 12, a second side wall 14, and a base 16.

In the embodiment of FIG. 1, each side wall 12, 14 extends about 340 mm away from the base 16. The base 16 has a width about 150 mm. Each panel extends about 2400 mm in a longitudinal direction.

The panel 10 is oriented such that the corrugations extend in the longitudinal direction. In the embodiment shown each side wall 12 represents about 3.5 corrugation wavelengths, with the base 16 representing nearly 1 corrugation wavelengths.

The arrangement is such that the first side wall 12 is connected to the base 16 along a first bend 22, the first bend 22 extending longitudinally along the panel 10. Similarly, the second side wall 14 is connected to the base 16 along a second bend 24, the second bend 24 extending longitudinally along the panel 10.

Figure 3:
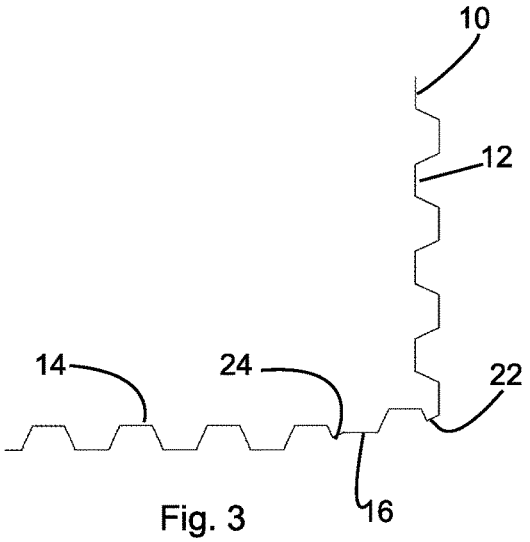
FIG. 3 is a schematic cross section of the wall panel of FIG. 1; shown in a second position.
Figure 4:
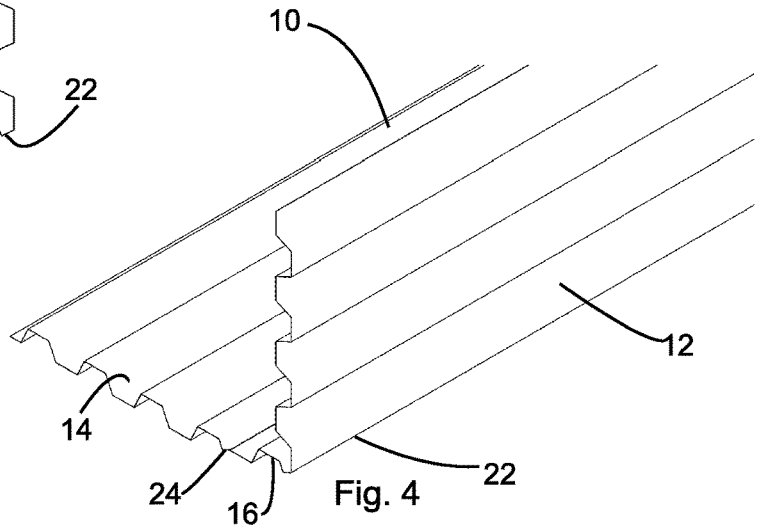
FIG. 4 is a perspective of an end of the wall panel of FIG. 3.

In the embodiment shown in FIGS. 3 and 4 the first bend 22 is a 90° bend. The second bend 24 is moveable from a straight configuration, wherein the panel 10 is generally L-shaped in cross section.

The bends 22, 24 are constructed so as to form a natural flexing point for the panel 10. This may be done by a thinning of material along the bend 22, 24, or by the provision of perforations, or other means. The arrangement is such that a small degree of pressure applied to the side walls 12, 14 will cause the panel 10 to move from the second position shown in FIGS. 3 and 4 to the first position shown in FIGS. 1 and 2, wherein the second side wall 14 has rotated relative to the base 16 around the second bend 24 into a 90° bend. It will be appreciated that this movement causes the first side wall 12 and the second side wall 14 to move into a parallel configuration, spaced by the base 16. The panel 10 thus forms a generally "U-shaped" configuration when viewed in cross section, as in FIG. 1. The panel 10 has the base 16 at an inner end, and an open space 28 at an outer end.

The first position shown in FIGS. 1 and 2 represents an assembled configuration, as will be described below. The second position shown in FIGS. 3 and 4 represents a possible storage configuration.

Figure 5:
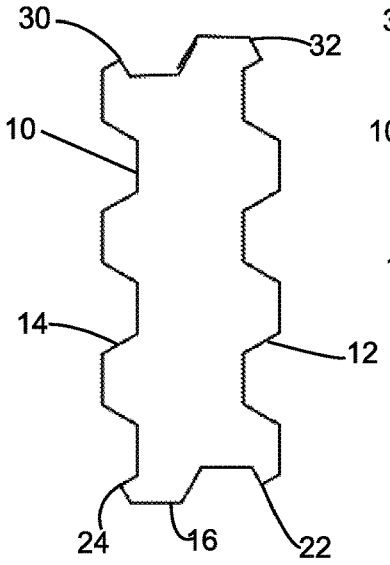
FIG. 5 is a schematic cross section of the wall panel of FIG. 1; shown in a third position.
Figure 6:
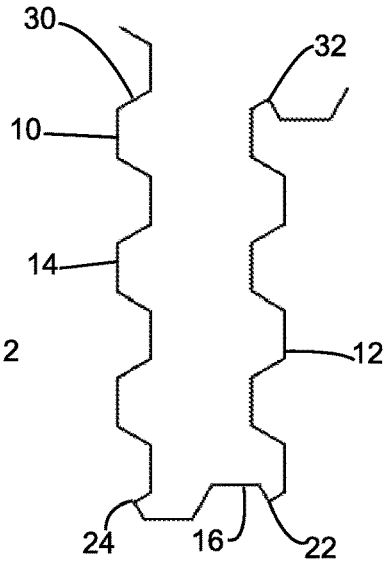
FIG. 6 is a schematic cross section of the wall panel of FIG. 1; shown in a fourth position.
Figure 7:
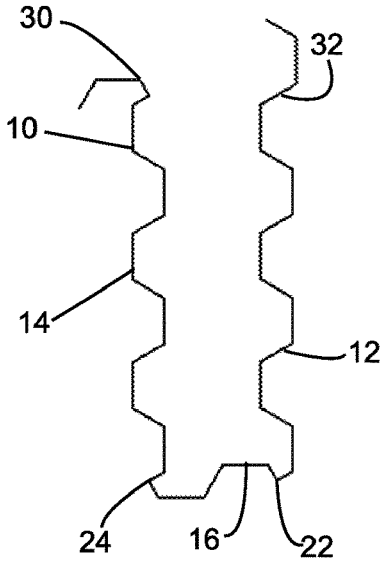
FIG. 7 is a schematic cross section of the wall panel of FIG. 1; shown in a fifth position.

FIGS. 5 to 7 show the panel 10 of FIGS. 1 to 4 with further bends, a third bend 30 and a fourth bend 32. The third bend 30 is located on the first side wall 12, about one half of a wavelength from its outer end. The fourth bend 32 is located on the second side wall 14, about one half of a wavelength from its outer end.

FIG. 5 shows the panel 10 in a third position, where each of the third and fourth bends 30, 32 have been folded internally at 90°, so as to close off the open space 28.

FIG. 6 shows the panel 10 in a fourth position, known as a 'left joint', in which the third bend 30 has been folded outwardly at 90°.

FIG. 7 shows the panel 10 in a fifth position, known as a 'right joint', in which the fourth bend 32 has been folded outwardly at 90°.

Figure 8:
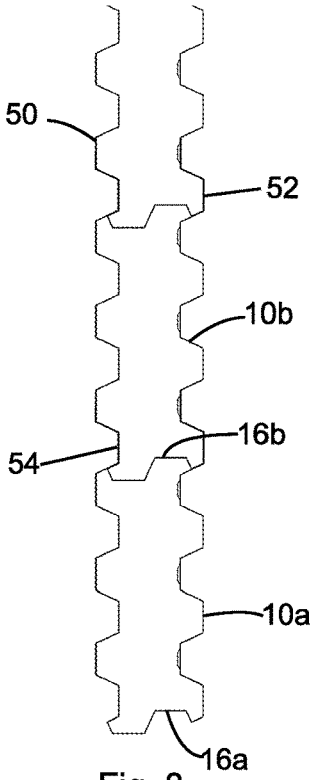
FIG. 8 is a schematic cross section of a wall portion constructed from wall panels such as those of FIG. 1.
Figure 9:
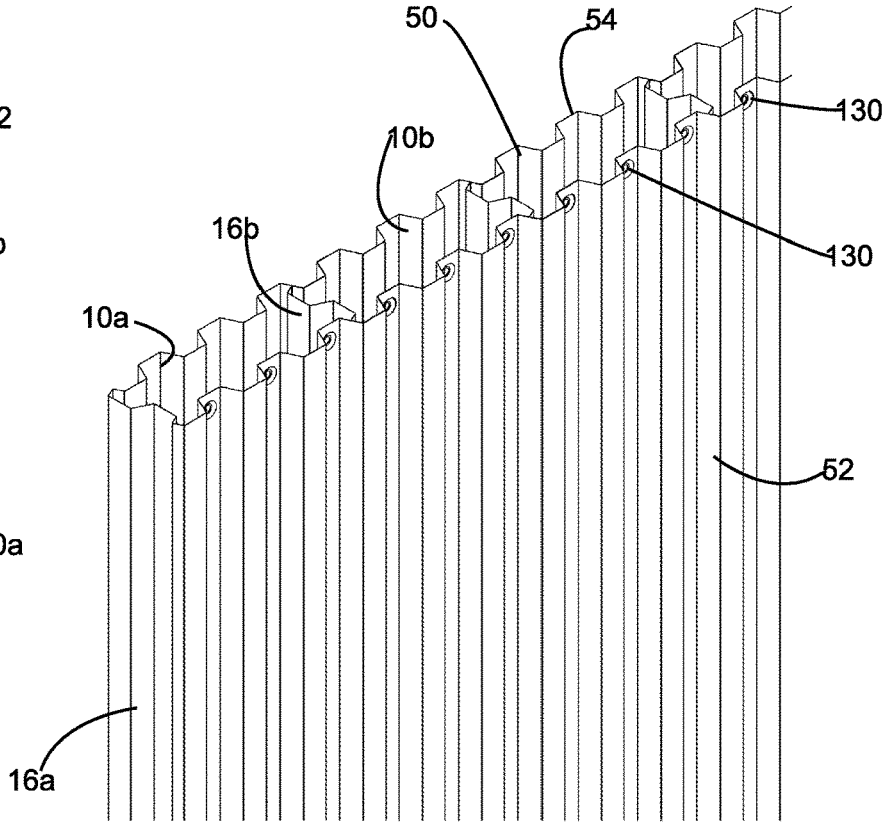
FIG. 9 is a perspective of the wall portion of FIG. 8.

FIGS. 8 and 9 show the assembling of a wall portion 50 using a plurality of panels 10, each in the assembled configuration of FIGS. 1 and 2. The wall portion 50 has first wall panel 10*a* positioned such that its base 16*a* represents an inner end of the wall portion 50, and its open space 28*a* faces towards an outer end of the wall portion 50.

A second panel 10*b* is introduced into the open space 28*a* of the first panel 10*a*. The second panel 10*b* faces in the same direction as the first panel 10*a*, with its open space 28*b* facing towards the outer end of the wall portion 50.

The second panel 10*b* is located about 0.75 corrugated wave length within the first panel 10*a*. In other words, the corrugated wave immediately next to the open space 28*a* of the first panel 10*a* locates outside of, and contiguous with, the corrugated wave immediately next to the base 16*b* of the second panel 10*b*, through to about 0.75 wavelengths. It will be appreciated that these waves are complementary in shape.

It can be seen that the wall portion 50 has side walls 52, 54 which are each the thickness of one side wall 12, 14 through their first three corrugations from the inner end, then the thickness of two side walls 12, 14 through a further 0.75 wavelengths. As successive panels 10 are added, it will be understood that the thickness of side walls 52, 54 alternates between one and two thicknesses.

It will be appreciated that an outer end of the wall 50 may be formed by incorporating a final panel 10 in the third position of FIG. 5.

Alternatively, an outer end of the wall 50 may be formed by incorporating a final panel 10 in the fourth position of FIG. 6 or the fifth position of FIG. 7. This allows the wall 50 to be connected to another wall 50 at a right angle, either to the left or the right. This arrangement is shown schematically in FIG. 10.

Figure 10:
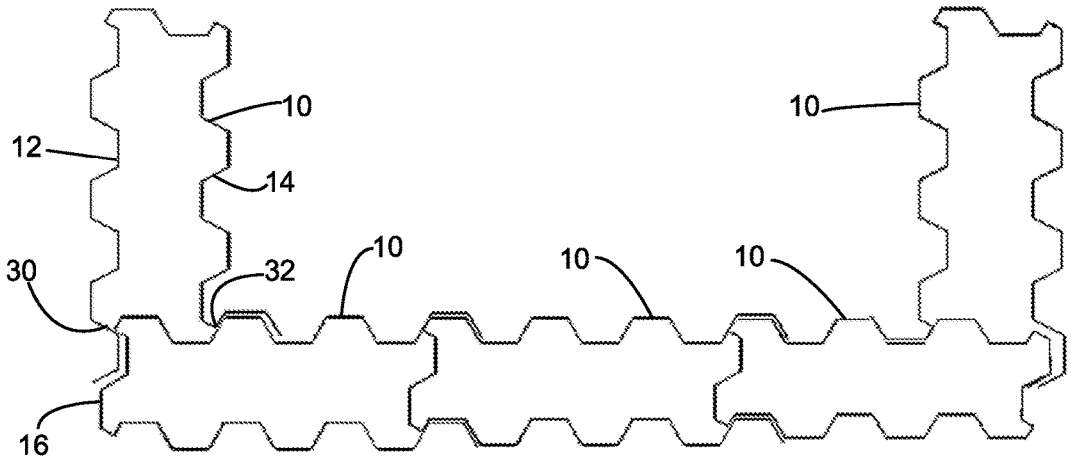
FIG. 10 is a schematic cross section of wall corners using panels such those of FIG. 1.
Figure 11:
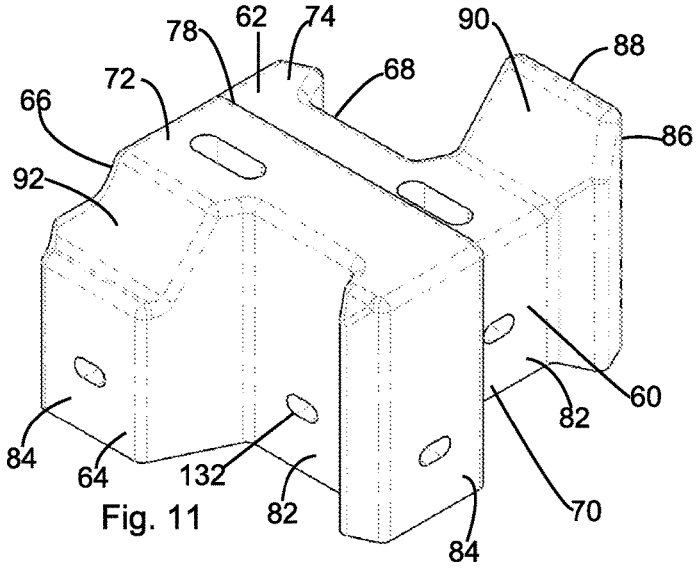
FIG. 11 is a first perspective of a connecting member for use with the wall portion of FIG. 8.
Figure 12:
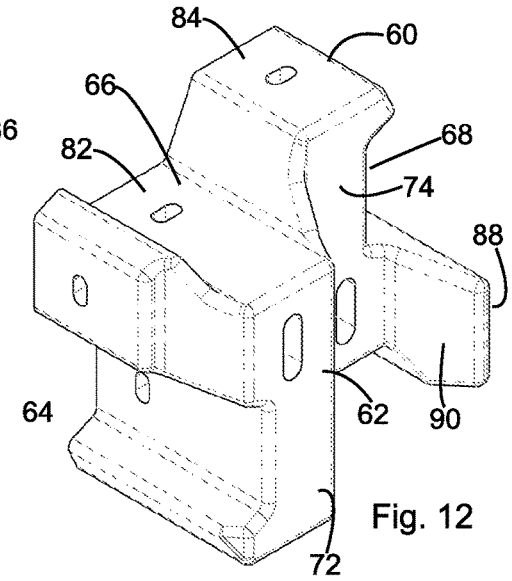
FIG. 12 is a second perspective of the connecting member of FIG. 11.
Figure 13:
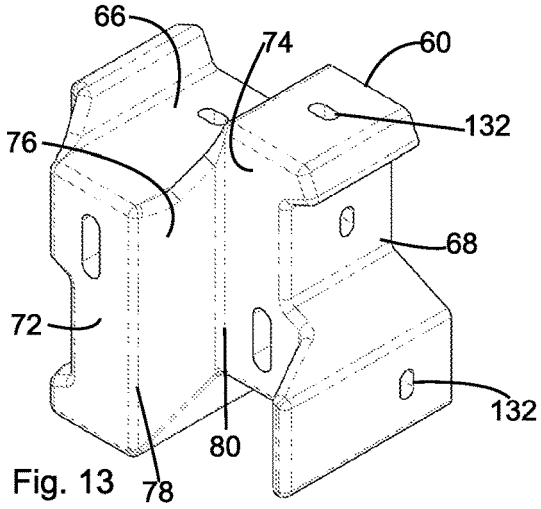
FIG. 13 is a third perspective of the connecting member of FIG. 11.
Figure 14:
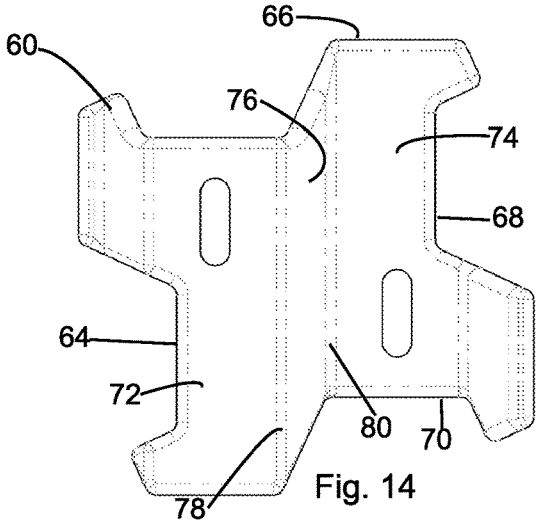
FIG. 14 is a plan view of the connecting member of FIG. 11.

In the arrangement of FIG. 10, it can be seen that the outer end the first side wall 12 (beyond the third bend 30) locates alongside the base 16 of an adjoining panel 10, with the bent outer end of the second side wall 14 locating part-way along a side wall 12, 14 of the adjoining panel 10. In both cases the outer ends of the side walls 12, 14 are complementary in shape to the corresponding regions of the adjoining panel 10.

The panel 10 is preferably used in conjunction with a connecting member or connecting block 60 as shown in FIGS. 11 to 14.

The connecting block 60 has an outer face 62 bordered by four side edges: a first side edge 64, a second side edge 66, a third side edge 68 and a fourth side edge 70.

The outer face 62 has a substantially planar raised surface 72 extending from the first side edge 64 towards the third side edge 68, and a substantially planar lowered surface 74 extending from the third side edge 68 towards the first side edge 64. The raised surface 72 and the lowered surface 74 are parallel to each other, and each extend about 45% of the way across the outer face 62.

A substantially planar sloped surface 76 connects the raised surface 72 and the lowered surface 74. The sloped surface 76 is generally rectangular, and extends from the second side edge 66 to the fourth side edge 70. The sloped surface 76 connects to the raised surface 72 along a first connection line 78 which is generally parallel to the first and third edges 64, 68. The sloped surface 76 connects to the lowered surface 74 along a second connection line 80 which is parallel to the first connection line 78. The sloped surface is angled at about 65° with respect to each of the raised surface 72 and lowered surface 74.

Each of the four side edges 64, 66, 68, 70 are shaped to locate within a single waveform of the panel 10 corrugations. They each have a recessed face 82 and an outward face 84, arranged to locate against 'convex' and 'concave' parts of the panel 10 waveform. The recessed faces 82 and outward faces 84 are all perpendicular to the raised surface 72 and lowered surface 74.

The third side edge 68 has an outwardly extending extension portion 86 on its outward face 84. The extension portion 86 extends above the lowered surface 74 to an upper edge 88 having a height corresponding to that of the raised surface 72. An internal face 90 extends from the upper edge 88 to the lowered surface 74, meeting the lowered surface 74 at an angle of about 65°.

The first side edge 64 has a cut-out portion 92 on its outward face 84, complementary in shape to the extension portion 86 on the third side edge 68.

Figure 15:
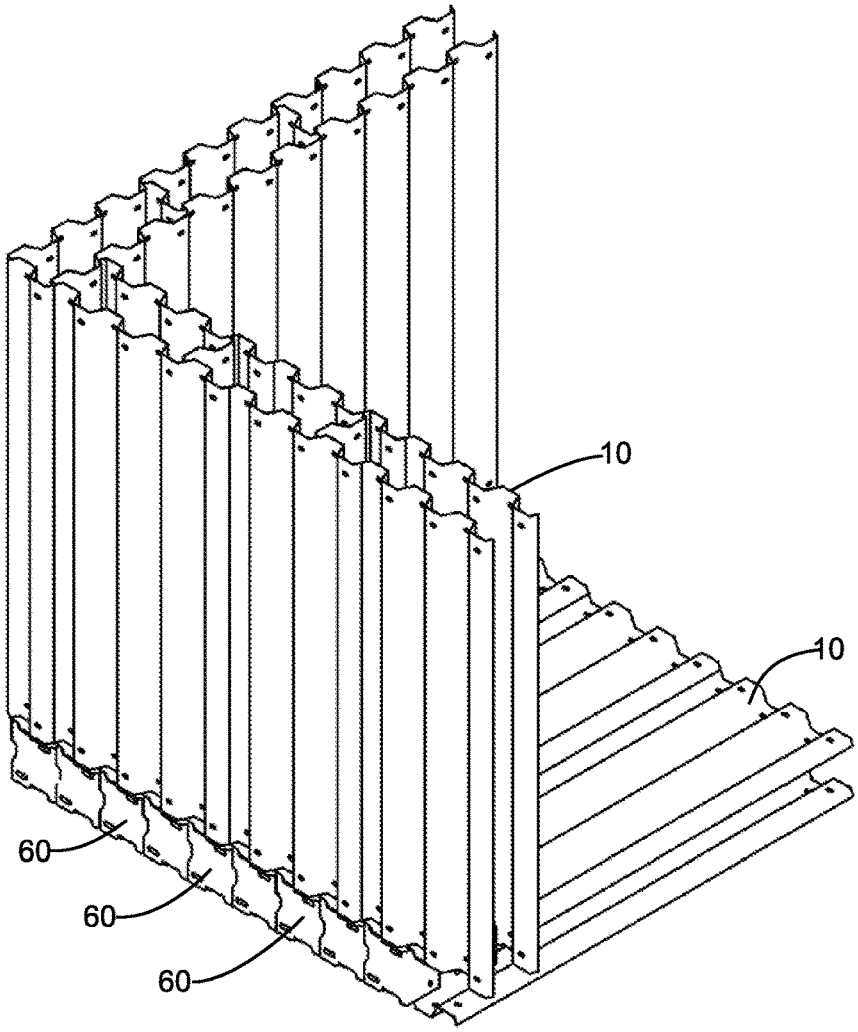
FIG. 15 is a perspective of a portion of a building formed from panels such as those of FIG. 1 with connecting members such as those of FIG. 11.

The connecting blocks 60 can be located in the panels 10 in two different configurations. In a first configuration, the connecting blocks 60 can be located in an orientation whereby the connection lines 78, 80 are perpendicular to the direction of the side walls 12, 14. This creates a stepped configuration along an upper or lower edge of the panel 10. The connecting blocks 60 are arranged to be inserted within the panel 10 such that the lowered surface 74 is level with an outer edge of the panel 10, with the raised surface 72 extending outside the edges of the panel 10. The resulting stepped configuration is complementary in shape to the side walls 12, 14 of a second panel 10, the second panel 10 being oriented at 90° first panel 10. This allows for the easy creation of 90° joins within a building, either wall-to-wall or wall-to-floor. This can be seen in FIG. 15.

In the second configuration, the connecting blocks 60 can be located in an orientation whereby the connection lines 78, 80 are parallel to the direction of the side walls 12, 14. The raised surfaces 72 of the connecting blocks 60 align to form a continuous raised surface, with the lowered surfaces 74 forming a continuous lowered surface. The resulting configuration is complementary in shape to a longitudinal edge of a second panel 10, oriented at 90° to the first panel 10. This allows for a wall-to-floor connection where the direction of floor corrugations is the same as the direction of the wall.

Figure 16:
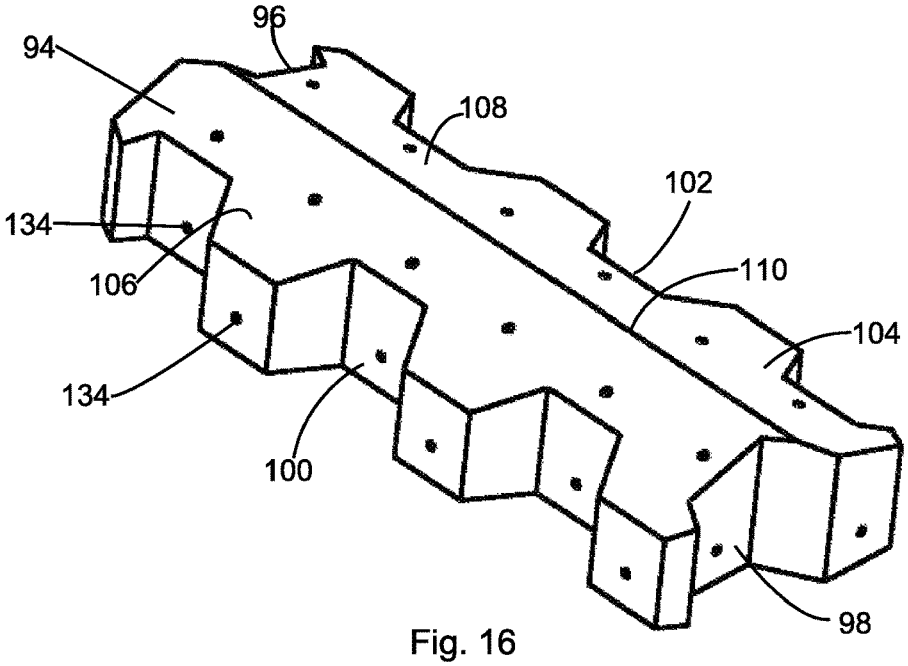
FIG. 16 is a perspective of a roof connecting member for use with the wall portion of FIG. 8.
Figure 17:
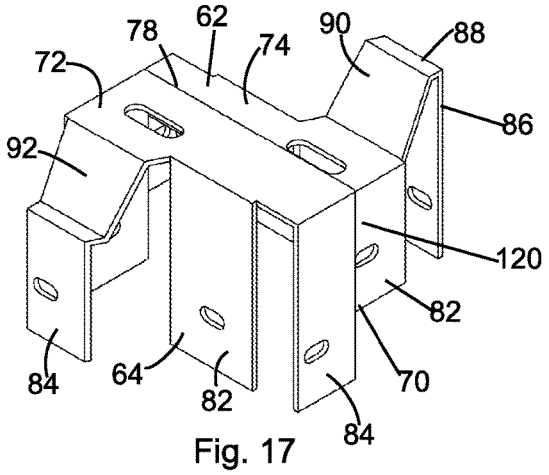
FIG. 17 is a first perspective of an alternative connecting member for use with the wall portion of FIG. 8.
Figure 18:
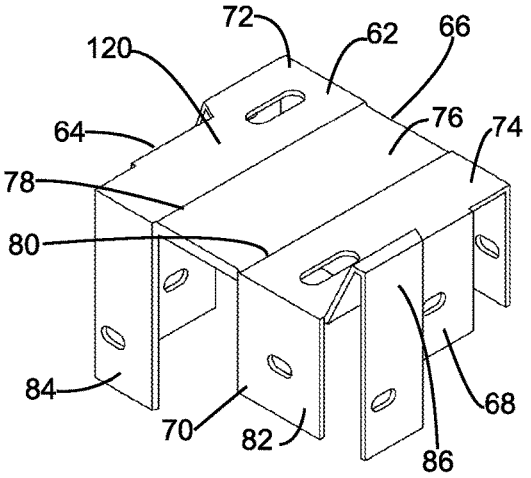
FIG. 18 is a second perspective of the connecting member of FIG. 17.
Figure 19:
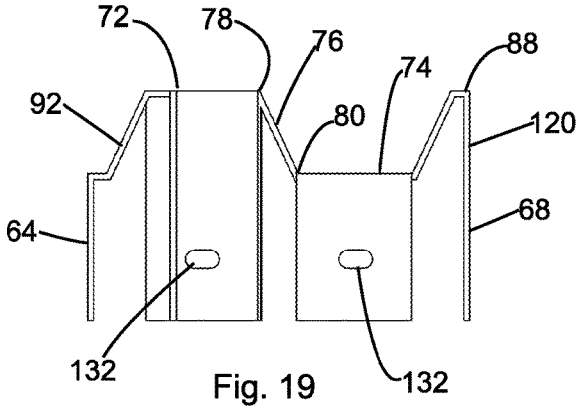
FIG. 19 is a first side view of the connecting member of FIG. 17.
Figure 20:
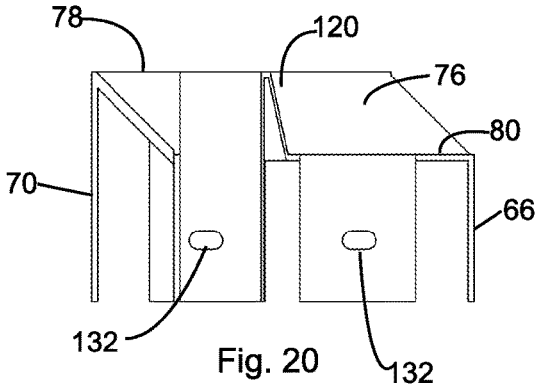
FIG. 20 is a second side view of the connecting member of FIG. 17.
Figure 21:
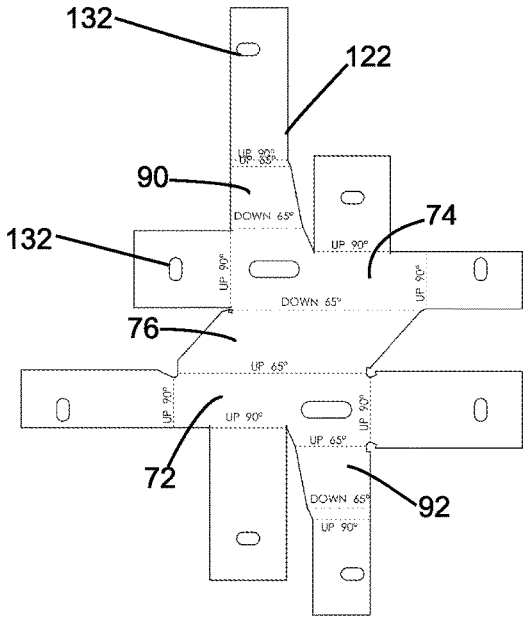
FIG. 21 is a pre-assembly plan view of the connecting member of FIG. 17.
Figure 22:
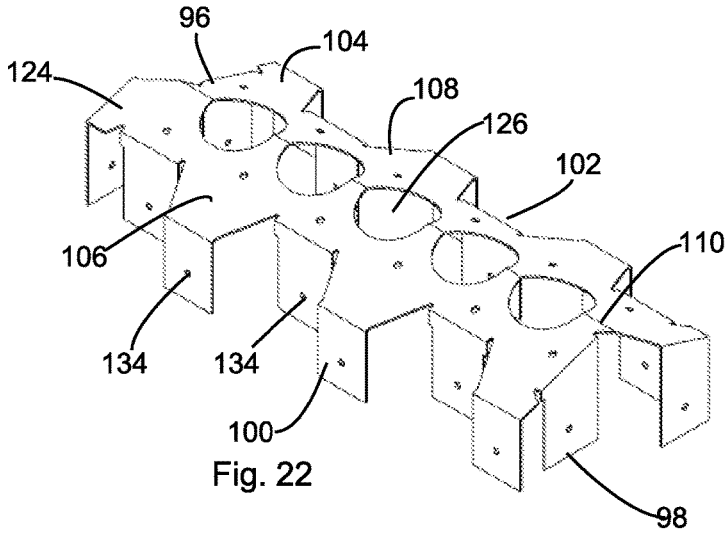
FIG. 22 is a perspective of an alternative roof connecting member for use with the wall portion of FIG. 8.
Figure 23:
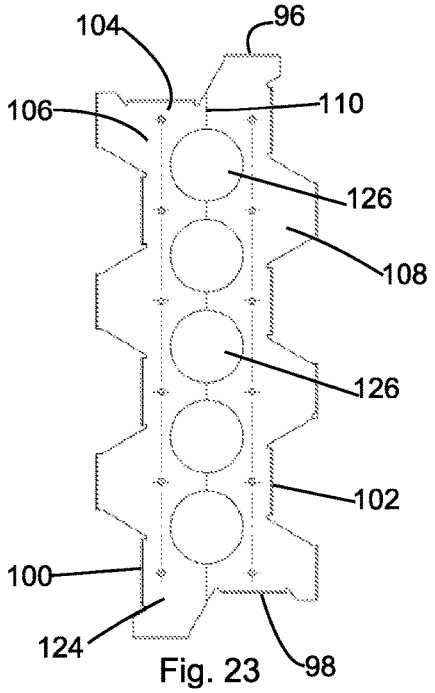
FIG. 23 is a plan view of the roof connecting member of FIG. 22.
Figure 24:
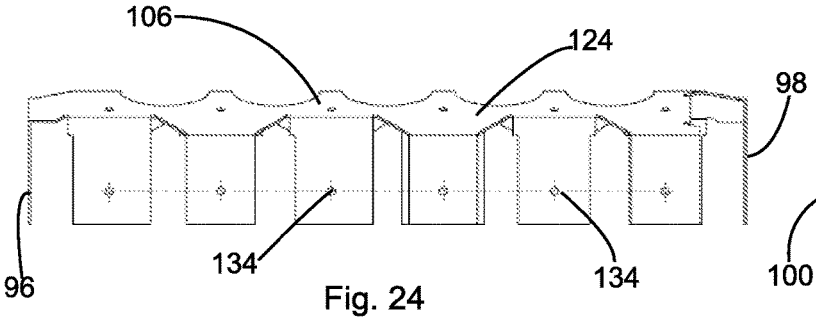
FIG. 24 is a side view of the roof connecting member of FIG. 22.
Figure 25:
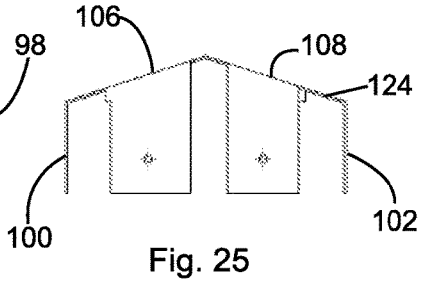
FIG. 25 is an end view of the roof connecting member of FIG. 22.

FIG. 16 shows a roof connector block 94. The roof connector block 94 has a first side edge 96 similar to first side edge 64 of the connecting block 60, and a third side edge 98 similar to the third side edge 68 of the connecting block 60. The roof connector block 94 has a second side edge 100 and a fourth side edge 102 which each extend through three corrugation waveforms.

The roof connector block 94 has an outer face 104 having a first portion 106 extending from the second side edge 100 towards the fourth side edge 102, and a second portion 108 extending from the fourth side edge 102 towards the second side edge 100. The first and second portions 106, 108 meet along a centre line 110. The first and second portions 106, 108 each angle up towards to the centre line 110 at an angle of about 18°. The arrangement is such that when a roof connector block 94 is inserted atop a wall panel 10 a roofing panel (not shown) can then be affixed to it, with the roof having an 18° pitch.

An alternative connecting block 120 is shown in FIGS. 17 to 21. The alternative connecting block 120 has the same principle features as the connecting block 60: an outer face 62 bordered by four side edges 64, 66, 68, 70; a substantially planar raised surface 72; a substantially planar lowered surface 74; a substantially planar sloped surface 76 and first and second connection lines 78, 80.

As with the connecting block 60, each of the four side edges 64, 66, 68, 70 of the alternative connecting block 120 are shaped to locate within a single waveform of the panel 10 corrugations, with a recessed face 82 and an outward face 84. The third side edge 68 has an outwardly extending extension portion 86 on its outward face 84.

The difference between the connecting block 60 and the alternative connecting block 120 is that the former is moulded into a desired shape, whereas the latter is formed from a single cut sheet 122 which is arranged to be folded into shape. As a consequence, the recessed faces 82 and outward faces 84 of the alternative connecting block 120 are not joined by interconnecting webs as in the connecting block 60.

Similarly, an alternative roof connector block 124 is shown in FIGS. 22 to 25. The alternative roof connector block 124 has all of the main features of the roof connector block 94, except is formed from a single cut sheet rather than being moulded. The alternative roof connector block 124 has a plurality of centrally located holes 126. The centrally located holes 126 both reduce the volume of material required to form the alternative roof connector block 124 and provide internal access to the panels 10, for instance for the insertion of insulation.

It will be understood that a connector block can be formed similarly to the roof connector block 124, with the outer face 104 being perpendicular to the side edges 96, 98, 100, 102. Such a connector block can be used in place of the connecting blocks 60, 120 to cap a panel, such as for a wall-to-floor connection. It is also anticipated that at least one connector block may be located internally of a panel 10 to provide stiffening if required.

Panels 10 can be locked to each other and/or locked to connecting blocks 60, 120 or roof connector blocks 94, 124 by means of apertures 130 located within each recessed corrugation of the first side wall 12 and second side wall 14. In use, these apertures 130 are arranged to align with associated apertures 132 in the connecting blocks 60, 120 or associated apertures 134 in the roof connector blocks 94, 124.

Figure 26:
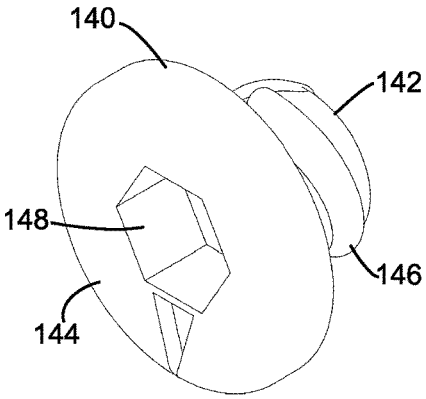
FIG. 26 is a first perspective of a fastener for use with the panel of FIG. 1.
Figure 27:
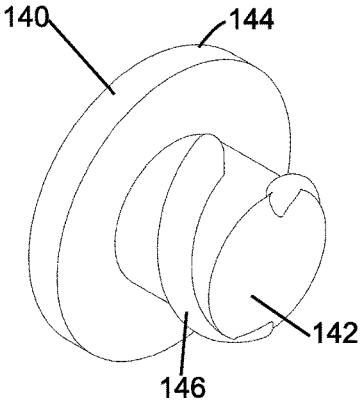
FIG. 27 is a second perspective of the fastener of FIG. 26.
Figure 28:
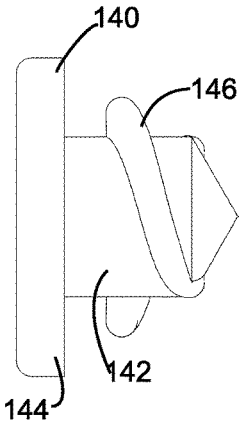
FIG. 28 is a side view of the fastener of FIG. 26.

The locking of panels 10 to each other or to connecting blocks 60, 120 is achieved by use of a fastener 140 as shown in FIGS. 26 to 28. Each fastener 140 has a shaft 142 extending from an annular head 144, with the shaft 142 having a wide thread 146 around its perimeter. The thread 146 is arranged to engage with the apertures 130, 132, 134. The fastener 140 has a single actuating socket 148 within the head 144, arranged to be operated by an Allen key or hex key, screw driver, or similar tool.

In a preferred embodiment of the invention, the apertures 130, 132, 134 may be associated with a recessed portion of the relevant body. This, it is envisaged, will assist in aligning apertures 130, 132, 134 and in easy locating of the fastener 140 within.

The panels 10 described above are envisaged being shipped either in the L-shaped second position of FIGS. 3 and 4, or as flat panels requiring bending around both first and second bends 22, 24 to achieve its assembled configuration of FIGS. 1 and 2. It will be appreciated that other shipping and storage arrangements are possible, particularly with some bending around first and/or second bends 22, 24 short of 90° bends.

Figure 29:
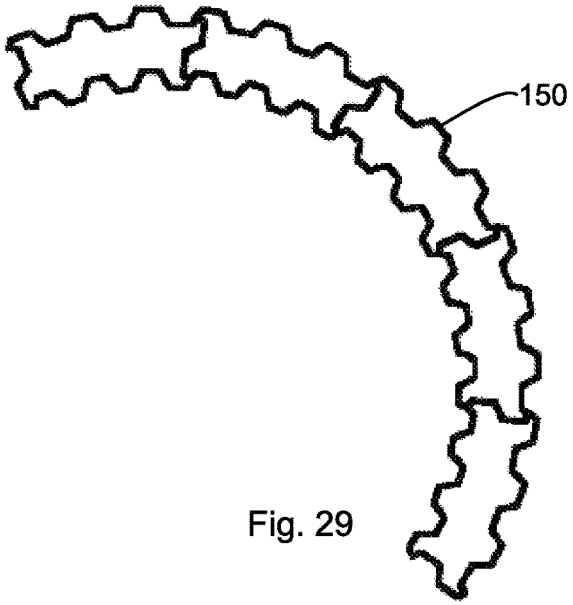
FIG. 29 is a schematic cross section of a wall portion constructed from wall panels in accordance with an alternative embodiment of the present invention.

It will be appreciated that while the wall portion 50 described above is straight, with a small change in the geometry of each panel 10 it is possible to form a curved wall portion 150. An exaggerated example of such a curved wall portion 150 is shown in FIG. 29.

Another alternative wall panel 210 is shown in FIGS. 30 to 33. The wall panel 210 is formed of a curvilinear corrugated material, and has a first side wall 212, a second side wall 214, and a base 216. The base 216 has a first base portion 218 and a second base portion 220.

Figure 32:
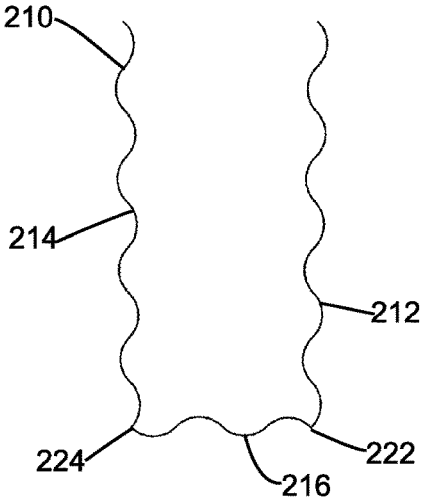
FIG. 32 is a cross section of the wall panel of FIG. 30, shown in a second position.

In the embodiment of FIG. 32, each side wall 212, 214 extends about 340 mm away from the base 216. The base 216 has a width about 150 mm. Each panel extends about 2400 mm in a longitudinal direction.

The panel 210 is oriented such that the corrugations extend in the longitudinal direction. In the embodiment shown each side wall 212 represents about 4.5 corrugation wavelengths, with the base 216 representing about 2 corrugation wavelengths.

The arrangement is such that the first side wall 212 is connected to the first base portion 218 along a first bend 222, the first bend 222 extending longitudinally along the panel 210. Similarly, the second side wall 212 is connected to the second base portion 220 along a second bend 224, the second bend 224 extending longitudinally along the panel 210. The first bend 222 and the second bend 224 are both 90° bends.

The first base portion 218 is connected to the second base portion 220 along a central bend 226. The central bend 226 is also about 90°, but on an opposite face of the panel 210 to the first and second bends 222, 224. The panel 210 thus forms a generally "W-shaped" configuration when viewed in cross section, as in FIG. 30.

The central bend 226 is constructed so as to form a natural flexing point for the panel 210. This may be done by a thinning of material along the central bend 226, or by the provision of perforations, or other means. The arrangement is such that a small degree of pressure applied to the side walls 212, 214 will cause the panel 210 to move from the first position shown in FIGS. 30 and 31 to a second position shown in FIGS. 32 and 33, wherein the first base portion 218 and the second base portion 220 have rotated relative to each other around the central bend 226 into a configuration where they are parallel, forming a straight base 216. It will be appreciated that this movement causes the first side wall 212 and the second side wall 214 to move into a parallel configuration, spaced by the base 216. The panel 210 thus forms a generally "U-shaped" configuration when viewed in cross section, as in FIG. 32. The panel 210 has a base 216 at an inner end, and an open space 228 at an outer end.

Figure 30:
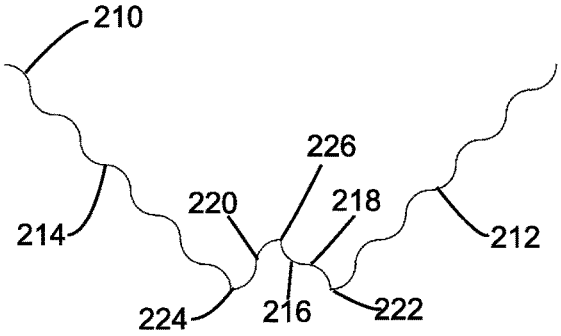
FIG. 30 is a cross section of a wall panel in accordance with an alternative embodiment of the present invention, shown in a first position.
Figure 31:
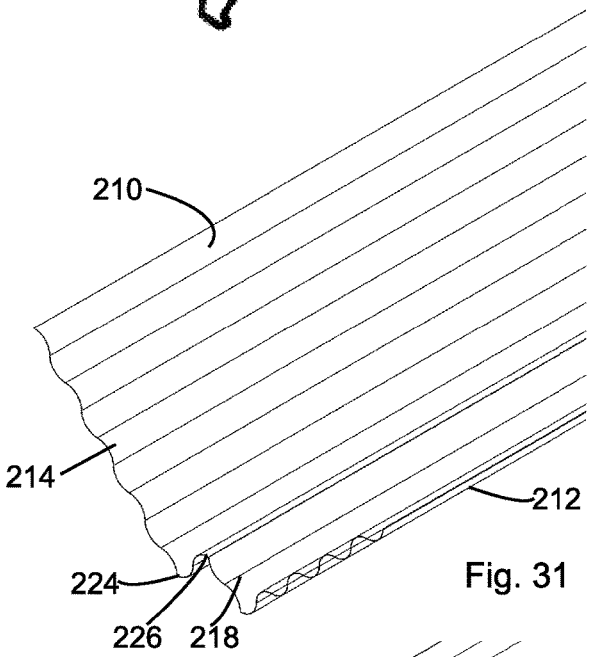
FIG. 31 is a perspective of an end of the wall panel of FIG. 30.
Figure 33:
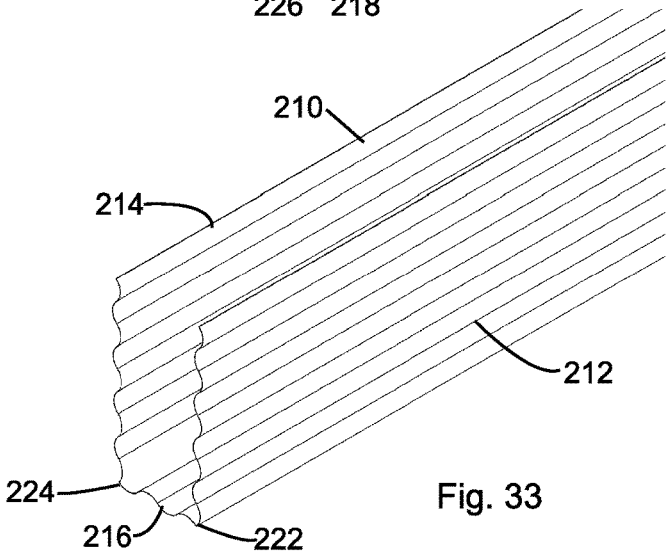
FIG. 33 is a perspective of the end of the wall panel of FIG. 32.

The first position shown in FIGS. 30 and 31 represents a storage configuration. The second position shown in FIGS. 32 and 33 represents an assembled configuration.

FIGS. 34 to 39 show various ways of assembling a wall portion using a plurality of panels 210, each in the assembled configuration. In each case the assembly will be described between a first panel 210*a* and a second panel 210*b*, although it will be understood that successive panels can be added in the same manner.

Figure 34:
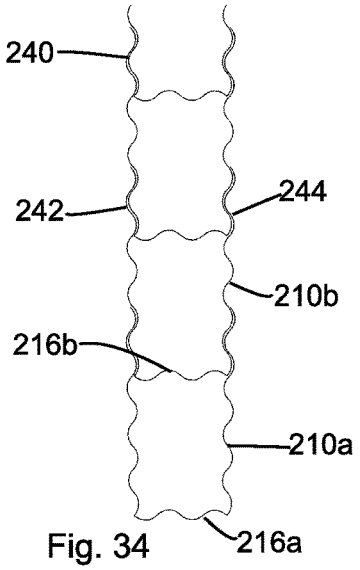
FIG. 34 is a cross section through a first embodiment of a wall portion formed from a plurality of wall panels such as those of FIG. 32.
Figure 35:
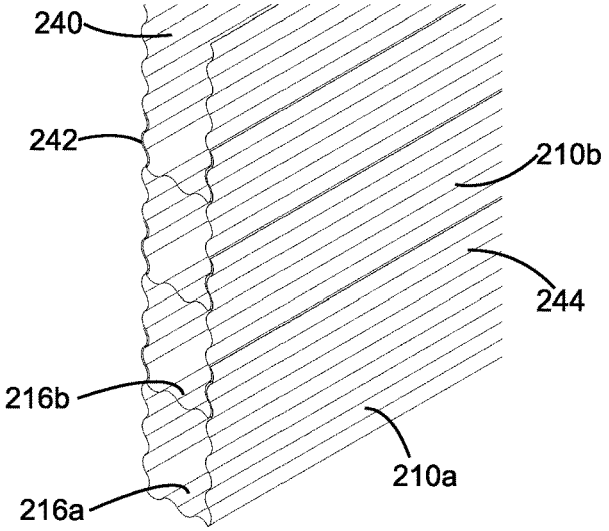
FIG. 35 is a perspective of an end of the wall portion of FIG. 34.

FIGS. 34 and 35 show a wall portion 240 having a minimal wall thickness of one sheet. In this embodiment a first panel 210*a* is positioned such that its base 216*a* represents an inner end of the wall portion 240, and its open space 228*a* faces towards an outer end of the wall portion 240.

A second panel 210*b* is introduced into the open space 228*a* of the first panel 210*a*. The second panel 210*b* faces in the same direction as the first panel 210*a*, with its open space 228*b* facing towards the outer end of the wall portion 240.

The second panel 210*b* is located about 1.5 corrugated wave length within the first panel 210*a*. In other words, the corrugated wave immediately next to the open space 228*a* of the first panel 210*a* locates outside of, and contiguous with, the corrugated wave immediately next to the base 216*b* of the second panel 210*b*, through to about 1.5 wavelengths. It will be appreciated that these waves are complementary in shape.

It can be seen that the wall portion 240 has side walls 242, 244 which are each the thickness of one side wall 212, 214 through their first three corrugations from the inner end, then the thickness of two side walls 212, 214 through a further 1.5 wavelengths. As successive panels 210 are added, it will be understood that the thickness of the side walls 242, 244 alternates between one and two thicknesses each 1.5 wavelengths.

It will be appreciated that an outer end of the wall 240 may be formed by reversing a final panel 210 such that its base 216 formes the outer end of the wall 240.

Figure 36:
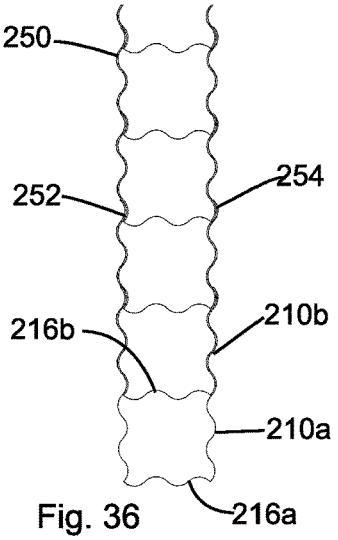
FIG. 36 is a cross section through a second embodiment of a wall portion formed from a plurality of wall panels such as those of FIG. 32.
Figure 37:
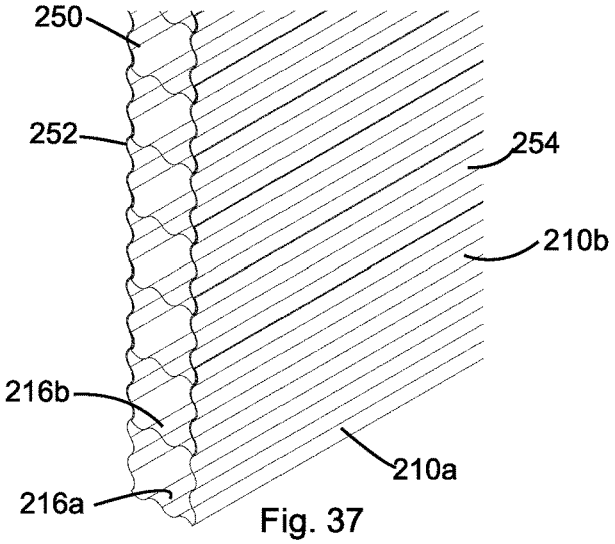
FIG. 37 is a perspective of an end of the wall portion of FIG. 36.

FIGS. 36 and 37 show a wall portion 250 having a minimal wall thickness along most of its extent of two sheets. In this embodiment the second panel 210*b* is located about 2.5 corrugated wave lengths within the first panel 210*a*.

It can be seen that the wall portion 250 has side walls 252, 254 which are each the thickness of one side wall 212, 214 through their first two corrugations from the inner end, then the thickness of two side walls 212, 214 through the next 2 wavelengths, and the thickness of three side walls 212, 214 through a further half a wavelength. As successive panels 210 are added, it will be understood that the thickness of the side walls 252, 254 alternates between two thicknesses for 1.5 wavelengths and then three thicknesses for the next 0.5 wavelength.

Figure 38:
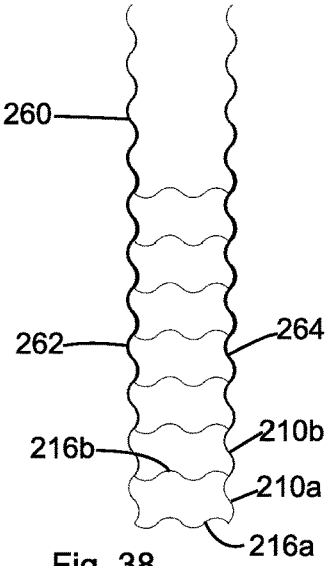
FIG. 38 is a cross section through a third embodiment of a wall portion formed from a plurality of wall panels such as those of FIG. 32.
Figure 39:
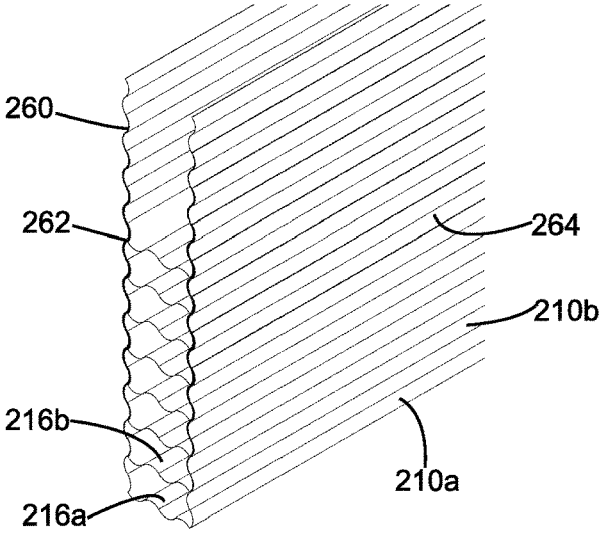
FIG. 39 is a perspective of an end of the wall portion of FIG. 38.

FIGS. 38 and 39 show a wall portion 260 having a minimal wall thickness along most of its extent of four sheets. In this embodiment the second panel 210*b* is located about 3.5 corrugated wave lengths within the first panel 210*a*.

It can be seen that the wall portion 260 has side walls 262, 264 which are each the thickness of one side wall 212, 214 through their first corrugation wavelength from the inner end, then the thickness of two side walls 212, 214 through the next wavelength, the thickness of three side walls 212, 214 through the next wavelength, the thickness of four side walls 212, 214 through the next wavelength and the thickness of five side walls 212, 214 through the final half a wavelength. As successive panels 210 are added, it will be understood that the thickness of the side walls 252, 254 alternates between four and five thicknesses each half wavelength.

Figure 40:
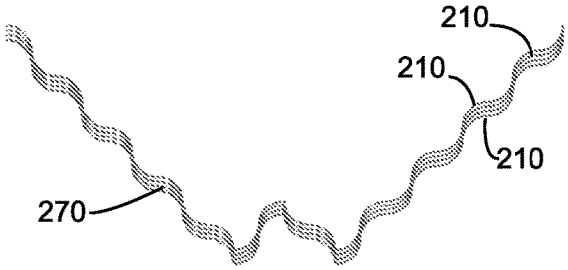
FIG. 40 is a cross section through a stack of wall panels such as those of FIG. 30.
Figure 41:
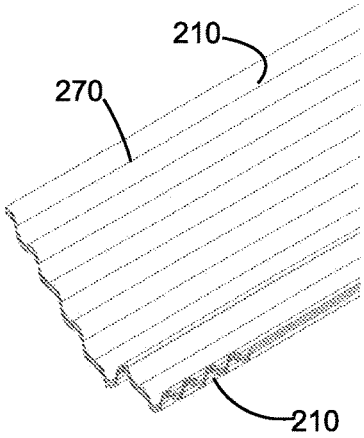
FIG. 41 is a perspective of the stack of wall panels of FIG. 40.

It will be understood that panels 210 in the first position of FIG. 30 can be readily stacked for transportation and storage, and readily removed from such a stack. FIGS. 40 and 41 show a stack 270 of panels 210 ready for transport.

Figure 42:
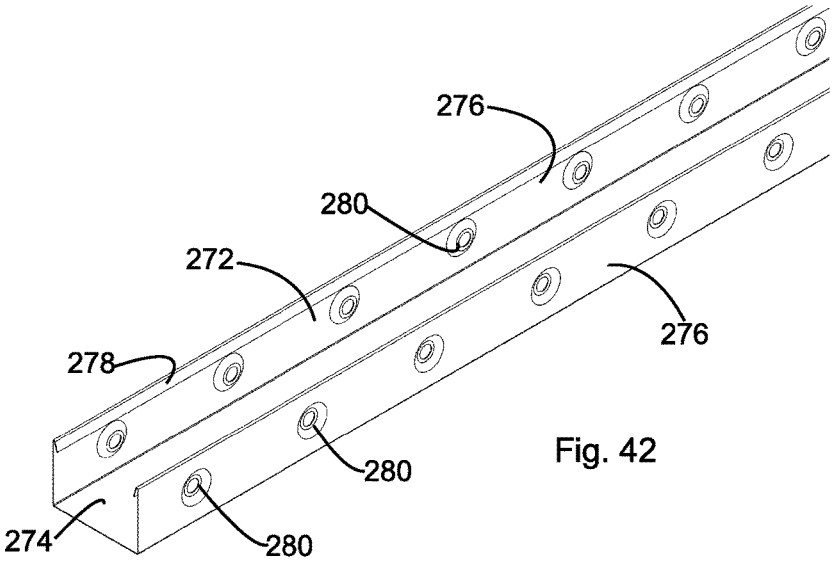
FIG. 42 is a perspective of a channel member for use in connection with the wall panels of FIG. 32, shown in a second position.

In use, wall portions 240, 250, 260 can be constrained within at least one channel member 272, as shown in FIG. 42. Each channel member 272 is generally U-shaped in cross section, with a central web 274 and two side flanges 276. The side flanges 276 each have an internal lip 278.

The arrangement is such that the side flanges 276 are spaced apart about the width of the base 216 of the panel 210.

Each side flange 276 has a plurality of receiving apertures 280 spaced along its length.

Figure 43:
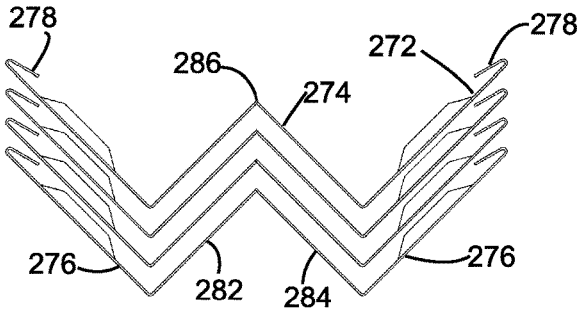
FIG. 43 is a cross section through a stack of channel members such as those of FIG. 42, shown in a first position.
Figure 44:
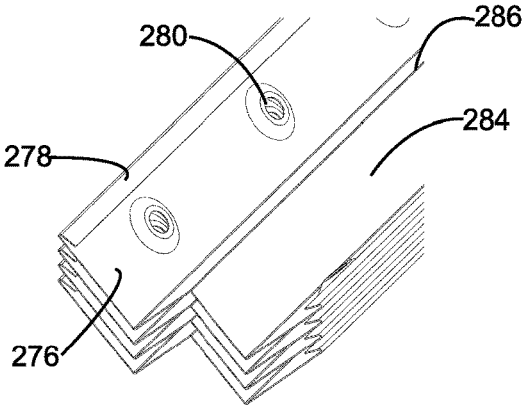
FIG. 44 is a perspective of the stack of channel members of FIG. 43.

As shown in FIGS. 43 and 44, the channel members 272 may have a longitudinal bend 286 along the web 274, separating it into a first web portion 282 and a second web portion 284. In this way the channel members 272 may be bent outwards into a "W-shape" for convenient stacking.

Figure 45:
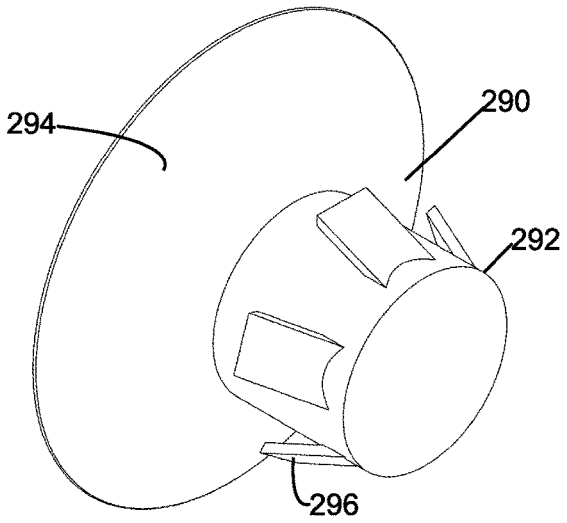
FIG. 45 is a perspective of a fastener for use in connection with the channel member of FIG. 42.
Figure 46:
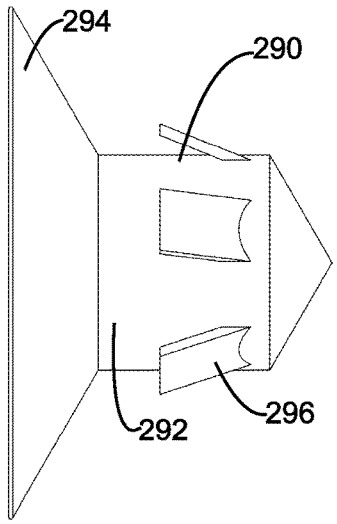
FIG. 46 is a side view of the fastener of FIG. 45.

FIGS. 45 and 46 show a deformable fastener 290 arranged for use in pinning the panels 210 into the channel members 272. Each fastener 290 has a shaft 292 extending from an annular base 294, with the shaft having a plurality of 'one way' click-in tabs 296 arranged about its perimeter. The fastener 290 is arranged to locate within a receiving aperture 280 of the channel member and corresponding apertures in the side walls 212, 214 of the panels 210 and to 'snap' into a locked position holding the panel 210 relative to the channel member 272.

Figure 47:
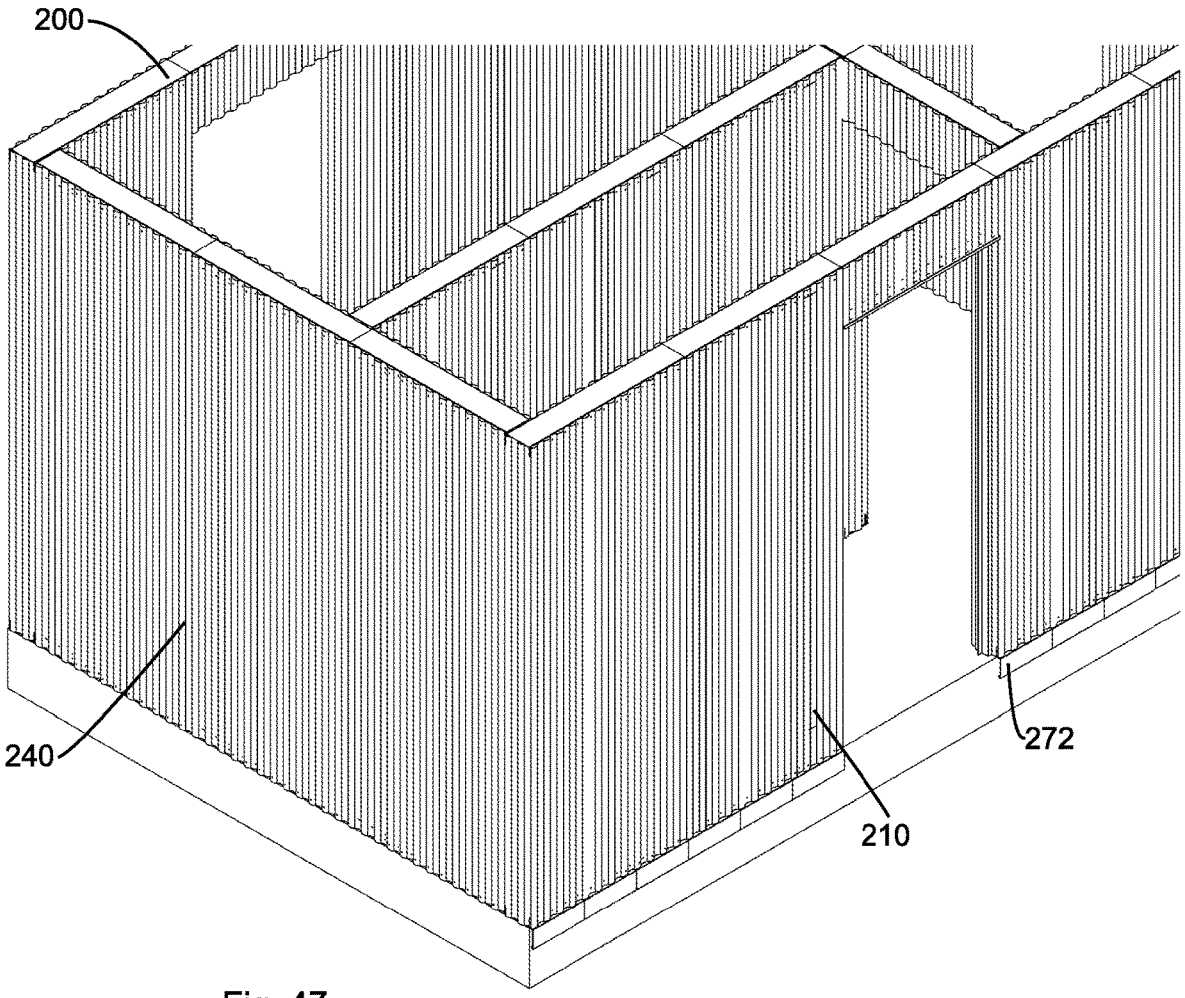
FIG. 47 is a schematic representation of a portion of a building constructed from wall panels such as those of FIG. 32.

FIG. 47 gives an example of how a building 200 can be constructed using the panels 210 and channel members 272. It will be appreciated that a similar construction can be achieved using the panels 10 and connecting blocks 60 of the earlier described embodiment.

It will also be appreciated that the panels 10, constructed from a more angular corrugated material than the panels 210, can be arranged in an analogous fashion to the wall panels 240, 250, 260 to create greater wall strength if required.

Modifications and variations as would be apparent to a skilled addressee are deemed to be within the scope of the present invention.

The invention claimed is:

1. A panel for use in a modular building as a section of a wall; the panel including:

a first side wall, a second side wall, and a base portion, each of which extends in a longitudinal direction, wherein the pan& is movable between a first position and a second position, the second position representing an assembled position in which the panel forms the section of the wall, wherein, when the panel is in the first position, the first side wall and the second side wall are angled with respect to each other, wherein, when the panel is in the second position, the first side wall is generally parallel to and opposed to the second side wall, wherein the panel includes further longitudinally extending bends located on the first side wall and/or the second side wall, wherein movement of at least one side wall portion about one of said further longitudinally extending bends permits movement of the panel into a third position in which the panel is closed at an outer end remote from the base portion, and wherein movement of at least one side wall portion one of said further longitudinally extending bends permits movement of the panel into a fourth position in which an outer portion of the first side wall and/or the second side wall extends away from the panel in a direction parallel to the base portion.

2. The panel as claimed in claim 1, wherein at least one of the first side wall and the second side wall is joined to the base portion along a longitudinally extending bend, whereby movement of the panel between its first and second positions is achieved by rotation of at least one of the first and second side walls relative to the base portion about the respective longitudinally extending bend.

3. The panel as claimed in claim 1, wherein at least one of the first side wall and the second side wall is joined to the base portion at a hinge, such that movement of the panel between its first and its second positions can be achieved by rotation of at least one of the first and second side walls relative to the base portion about the respective hinge.

4. The panel as claimed in claim 1, wherein the base portion includes a first base portion joined to a second base portion along a longitudinally extending bend, whereby movement of the panel between its first and second positions is achieved by movement of the first base portion relative to the second base portion about the longitudinally extending bend.

5. The panel as claimed in claim 4, wherein the first base portion is connected to the first side wall at a bend of about 90°, and the second base portion is connected to the second side wall at a bend of about 90°.

6. The panel as claimed in claim 1, wherein the base portion locates internally of the side walls when in its first position.

7. The panel as claimed in claim 1, wherein the panel is constructed from a corrugated material, having ridges and grooves extending in the longitudinal direction.

* * * * *